United States Patent [19]

McMahon, Jr.

[11] 4,215,489

[45] Aug. 5, 1980

[54] ROLLER DRYER

[75] Inventor: Irven J. McMahon, Jr., Painesville, Ohio

[73] Assignee: The Coe Manufacturing Company, Painesville, Ohio

[21] Appl. No.: 924,889

[22] Filed: Jul. 17, 1978

Related U.S. Application Data

[63] Continuation of Ser. No. 743,759, Nov. 22, 1976, abandoned.

[51] Int. Cl.[2] ..... F26B 25/00

[52] U.S. Cl. ..... 34/242; 34/66

[58] Field of Search ..... 34/242, 210, 213, 214, 34/216, 217, 92, 66

[56] References Cited

U.S. PATENT DOCUMENTS

| | | | |
|---|---|---|---|
| 2,443,443 | 6/1948 | Chavannes | 34/242 X |
| 2,810,662 | 10/1957 | Barnebey | 34/242 X |
| 2,890,878 | 6/1959 | Steinherz | 34/242 X |
| 3,032,890 | 5/1962 | Brick et al. | 34/242 X |
| 3,234,661 | 2/1966 | Nerge | 34/242 X |
| 3,299,533 | 1/1967 | Morris | 34/205 |
| 3,460,359 | 8/1969 | Schiffer | 34/242 X |
| 4,026,037 | 5/1977 | Buchholz | 34/216 X |

*Primary Examiner*—Albert J. Makay
*Assistant Examiner*—Harold Joyce
*Attorney, Agent, or Firm*—Watts, Hoffmann, Fisher & Heinke Co.

[57] ABSTRACT

An elongated generally horizontal stationary housing having generally horizontal, continuous conveyors extending therethrough and including a material drying zone or chamber for reducing the moisture content of material conveyed therethrough and a gas seal zone or chamber having an exhaust fan connected thereto at the material discharge end of the drying chamber. Hot gases are circulated through the drying chamber from the material entrance end to the material exit end of the drying chamber by a fan located in a recirculating duct connected to the opposite ends of the drying chamber and which fan maintains a subatmospheric pressure in the material exit end of the drying chamber. During return of the drying gases to the material entrance end of the drying chamber the temperature of the gases being circulated is increased. Baffles are provided at the material exit end of the seal chamber to restrict the entrance of air into the seal chamber at the material exit end thereof. The gas exhaust fan connected to the seal chamber maintains predetermined relative gas pressures in the adjoining ends of the drying chamber and the seal chamber such that the subatmospheric gas pressure in the seal chamber is never greater than and preferably less than the subatmospheric gas pressure in the material discharge end of the drying chamber.

9 Claims, 5 Drawing Figures

ROLLER DRYER

RELATED APPLICATIONS

This application is a continuation of copending application Ser. No. 743,759, filed Nov. 22, 1976, abandoned entitled ROLLER DRYER.

BACKGROUND OF THE INVENTION

1. Field of the Invention

The invention relates to apparatus for drying rigid or semi-rigid sheet material having one or a plurality of tiered horizontal conveyors and utilizing force circulated, horizontal flow, gases in contact with the material to be dried for drying the same.

2. Description of the Prior Art

Single and multiple deck roller dryers for reducing the moisture content of rigid and semi-rigid material in sheet form, such as, green veneer, wet plasterboard, fiberboard, Masonite mat, and the like, wherein the material being dried is conveyed through a stationary housing on one or a plurality of tiered single or double roll conveyors while heated gases are circulated through the housing or a part thereof are known. Such devices have many disdvantages one of which is loss of efficiency because of the entrance of air at ambient temperature into the dryer through the material discharge opening or openings in the dryer.

Roll conveyors are typically employed in dryers of the type with which the present invention is particularly concerned. Single roll conveyors are usually employed in so-called "board" dryers used in the manufacture of such products as fiberboard, plasterboard, and the like, and double or pinch roll conveyors are typically employed in so-called "veneer" dryers because veneer tends to warp upon drying. In either single or double roll dryers the material is typically discharged through pinch rolls at the material discharge end thus making it easier to seal the material discharge end of the dryer then when a single roll is employed. The loss of efficiency in dryers employing pinch rolls at the discharge end is nevertheless substantial. A typical pinch roll type dryer is disclosed in U.S. patent to Morris U.S. Pat. No. 3,299,533.

SUMMARY OF THE INVENTION

The present invention provides a dryer for reducing the moisture content of material in sheet form wherein hot gases are longitudinally circulated from the "wet" end to the "dry" end of a material drying chamber from which they are withdrawn from the dry end at pressures less than atmospheric, reheated and returned to the "wet" end, a seal chamber at the material discharge end of the drying chamber, and means for maintaining the gas pressure in the seal chamber not greater than and preferably less than the gas pressure in the adjoining end of the drying chamber thereby preventing gas flow from the seal chamber into the drying chamber and thus eliminating the leakage of air at ambient temperature into the drying chamber at the dry end thereof and increasing the efficiency of the dryer.

DESCRIPTION OF THE PREFERRED EMBODIMENT

Figure 1:
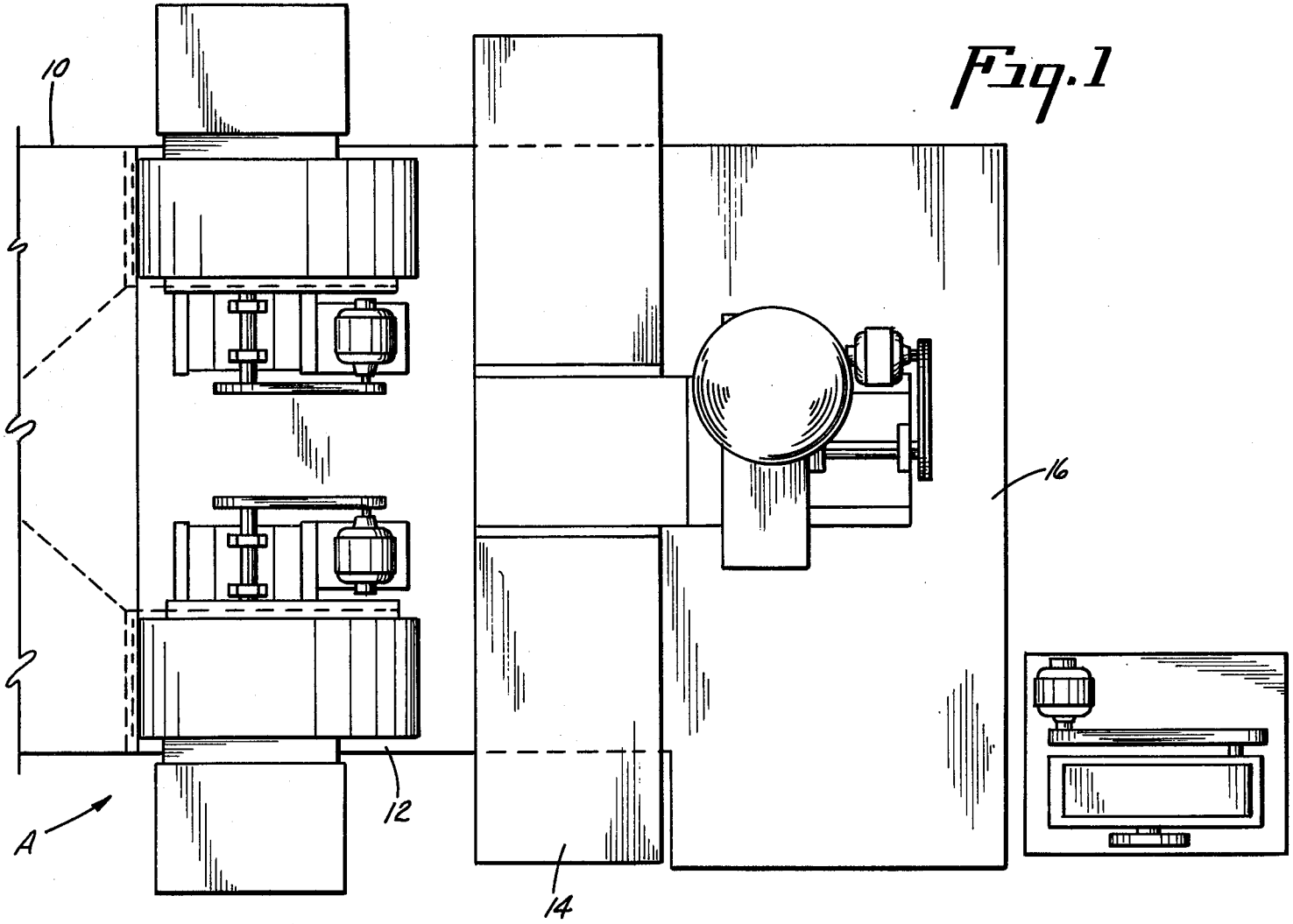
FIG. 1 is a fragmentary plan view of a dryer embodying the present invention.
Figure 2:
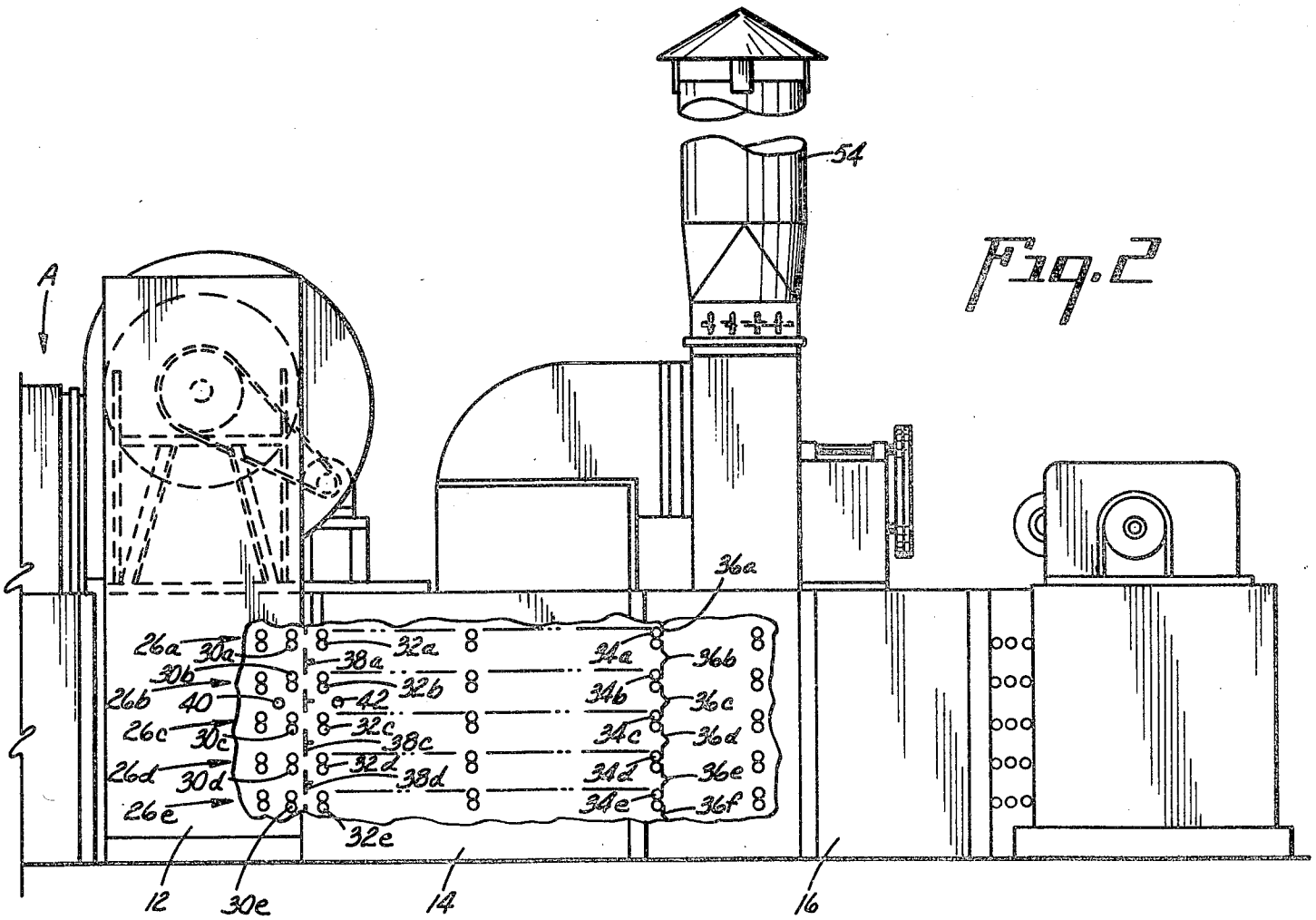
FIG. 2 is a side elevation view with part of the housing broken away of the apparatus shown in FIG. 1.
Figure 3:
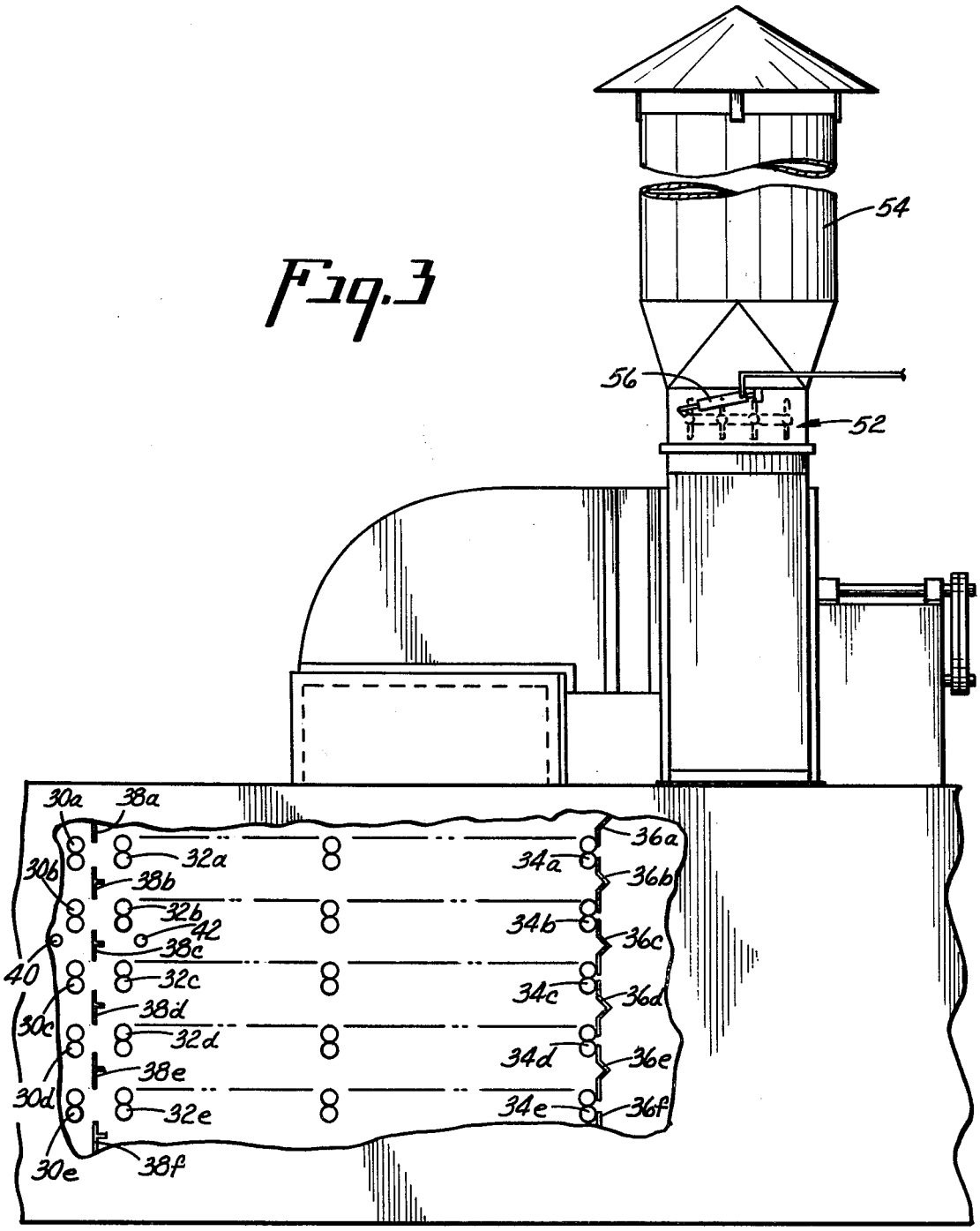
FIG. 3 is a fragmentary enlarged view of a portion of FIG. 2.
Figure 4:
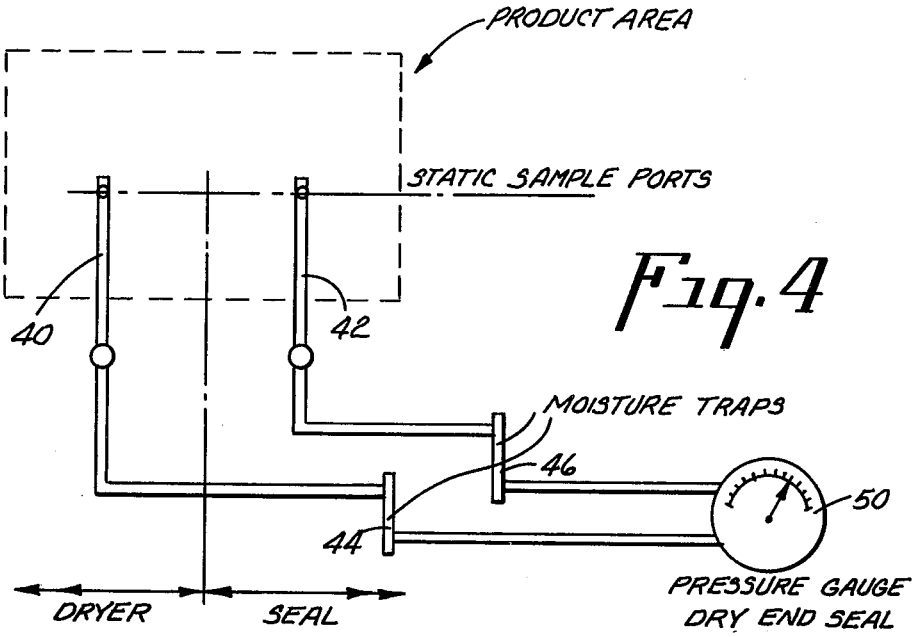
FIGS. 4 and 5 are diagrammatic views of controls used with the apparatus shown in FIGS. 1 to 3.
Figure 5:
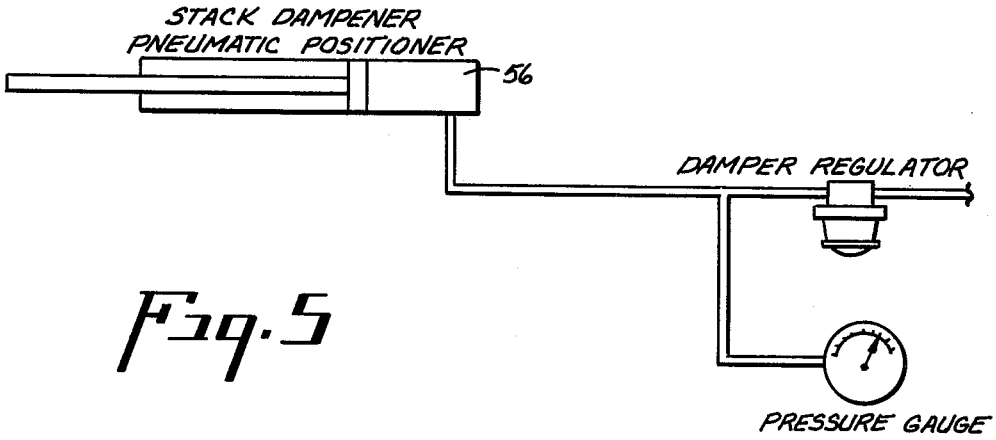

Although the invention is applicable to various types of dryers for drying material in sheet form including "board" dryers, that is, dryers especially designed for drying board material, such as fiberboard, plasterboard and the like, it is herein shown and described in a horizontal gas flow multiple deck double or pinch roll conveyor type dryer in which the flow of drying gases in the material drying chamber or zone of the single air system dryer depicted or the last drying chamber or zone of a multiple air or gas system dryer is from the material entrance end to the material discharge end, that is, from the "wet" end to the "dry" end.

The exemplary drying apparatus shown in the drawings is designated generally by the reference character A and comprises an elongated horizontal housing or dryer 10 comprising a drying chamber or zone 12, a gas seal chamber or zone 14 and a material cooling chamber or zone 16. With the exception of the seal chamber or zone including certain devices associated therewith the dryer A is similar to the single air system dryer disclosed in aforesaid Morris U.S. Pat. No. 3,299,533, the disclosure of which is incorporated herein by reference, and will not be described in detail.

The material conveying pinch roll type endless conveyors, of which there are five (5) in the embodiment shown located one above the other, that is, tiered and are designated generally by the reference characters 26(*a*) to 26(*e*), extend through the dryer. The pairs of pinch rolls 34*a* to 34*e* at the exit end of the seal chamber 14 are in vertical alignment. The arrangements of the other pinch rolls are a matter of choice. In fact the other conveying parts of the conveyors may be of any suitable construction including the single roll type. The reference characters 36*a* to 36*f* represent baffles between the respective pairs of pinch rolls at the material discharge end of the seal chamber and the upper and lower walls thereof to restrict the flow of air into the seal chamber through the material exit end of the seal chamber. Baffles at the material discharge end of the drying chamber 12 which restrict the flow of gas therethrough are indicated by the reference characters 38*a* to 38*f*. These baffles, however, are not as critical or important as the baffles 36*a* to 36*f* at the material exit end of the seal chamber.

Reference characters 40, 42 designate gas pressure sensors in the dry or material exit end of the drying chamber 12 and in the material entrance end of the seal chamber 14, respectively. The pressure sensors are connected through moisture traps 44, 46, respectively, to a differential pressure gauge 50, such as, a 2000 series magnehelic pressure gauge Model no. 2302 manufactured by Dwyer Instruments. A stack damper 52 in a stack 54 can be adjusted to control the volume of gas discharge from the seal chamber or zone through the stack 54 through which gas is normally discharged by an exhaust fan located in the stack 54 and driven by a motor 60. The damper 52 is adjusted by a pneumatic cylinder or positioner 56, for example, a Hagan type thrust power positioner No. 478749-2. The damper 52 can be controlled manually or alternatively, it can be connected to the pressure sensors 40, 42 so that predetermined relative pressures are automatically maintained at the material discharge end of the drying chamber 12 and the material entrance end of the seal chamber 14. Pressure sensors of the type referred to and the other control equipment mentioned are commercially available and are not herein shown and described in detail.

By maintaining equal pressures, which are normally less than atmospheric at the material discharge end of the drying chamber and the material entrance end of the seal chamber, or a higher pressure at the dry end of the drying chamber than that at the entrance end of the seal chamber, the ingress of gases into the drying chamber through the material discharge openings and/or the space between conveyors is prevented. This will increase the efficiency of the apparatus. In a prototype installation the saving in B.T.U. per pound of water removed was over 200 B.T.U. which is in the order of 10% of the gross thermal input to the dryer.

From the foregoing description of the preferred embodiment it will be apparent that the objects heretofore enumerated have been accomplished and that the present invention provides means for preventing the ingress of air at ambient temperatures into the material discharge end of the drying chamber of a dryer of the character to which the invention relates, thus increasing the efficiency of the dryer. While the preferred embodiment of the invention has been illustrated and described it is to be understood that the invention is not limited to the construction shown but may be otherwise embodied and it is the intention to hereby cover all adaptations, modifications and uses of the invention which come within the practice of the art to which the invention relates and the scope of the appended claims.

What I claim is:

1. In a dryer for reducing the moisture content of material in sheet form comprising an elongated generally horizontal stationary housing having material entrance and discharge ends, a continuous conveyor extending through the housing which includes a material drying chamber intermediate its ends and through which the conveyor extends, means externally of the drying chamber for producing a flow of gas lengthwise therethrough in the direction in which the material is conveyed through said drying chamber and maintaining a gas pressure less than atmospheric in the material exit end of the drying chamber, and means for heating the gas, the improvement comprising providing a gas seal chamber at the material discharge end of said drying chamber, means adjacent to the material discharge end of said seal chamber for restricting the flow of gas into said seal chamber, power actuated means connected to said seal chamber for exhausting gas from said seal chamber, and means for controlling the amount of gas exhausted from said seal chamber by said exhaust means whereby the gas pressure in said seal chamber may be maintained less than that of the subatmospheric gas pressure in the material exit end of the drying chamber.

2. In a dryer for reducing the moisture content in sheet form comprising an elongated generally horizontal stationary housing having material entrance and discharge ends, a continuous conveyor extending through the housing for conveying material to be processed through the housing which includes a material drying chamber intermediate its ends and through which the conveyor extends, means externally of the drying chamber for producing a flow of gas lengthwise through said drying chamber in the direction in which the material is conveyed therethrough and maintaining a gas pressure less than atmospheric in the material exit end of said drying chamber, and means for heating the gas, the improvement comprising providing a gas seal chamber at the discharge end of said drying chamber, means adjacent to the material discharge end of said seal chamber for restricting the flow of gas into said seal chamber, an exhaust fan connected to said seal chamber, means for sensing a condition in said housing upstream from said seal chamber, and means for controlling the amount of gas exhausted from said seal chamber by said exhaust fan to maintain a gas pressure in said seal chamber less than that of the subatmospheric gas pressure in the material discharge end of said drying chamber.

3. In a dryer for reducing the moisture content of material in sheet form comprising an elongated generally horizontal stationary housing having material entrance and discharge ends, a continuous conveyor extending through the housing for conveying material to be processed through the housing which includes a material drying chamber intermediate its ends and through which the conveyor extends, means externally of the drying chamber for producing a flow of gas lengthwise therethrough in the direction in which the material is conveyed through said drying chamber and maintaining a gas pressure less than atmospheric in the material exit end of said drying chamber, and means for heating the gas, the improvement comprising providing a gas seal chamber adjacent to the material discharge end of said drying chamber, means adjacent to the discharge end of said seal chamber for restricting the flow of gas into said seal chamber, an exhaust fan connected to said seal chamber and discharging through a stack having an adjustable damper, and power means operatively connected to said damper for adjusting said damper to control the amount of gas discharged from said seal chamber by said exhaust fan whereby the gas pressure in said seal chamber may be maintained less than that of the subatmospheric gas pressure in the material exit end of the drying chamber.

4. In apparatus for reducing the moisture content of material in sheet form comprising an elongated generally horizontal stationary housing having material entrance and discharge ends, a continuous conveyor extending through the housing for conveying material to be processed through the housing which includes a material drying chamber intermediate its ends and through which the conveyor extends, means externally of the drying chamber for producing a flow of gas lengthwise through said drying chamber and maintaining a gas pressure less than atmospheric in the material exit end of said drying chamber, and means for heating the gas, the improvement comprising providing a gas seal chamber adjacent to the material discharge end of said drying chamber, means adjacent to the material discharge end of said seal chamber for restricting the flow of gas thereinto, an exhaust fan connected to said seal chamber and discharging through a stack having an adjustable damper, and control means operatively connected to said damper for adjusting said damper to control the amount of gas exhausted from said seal chamber by said exhaust fan to maintain a gas pressure in said seal chamber less than that of the subatmospheric gas pressure in the material discharge end of said drying chamber, said control means including means for sensing a gas pressure condition in said dryer.

5. In apparatus for reducing the moisture content of material in sheet form comprising an elongated generally horizontal stationary housing having material entrance and discharge ends, a continuous conveyor extending through the housing for conveying material to be processed through the housing which includes a material drying chamber intermediate its ends and through which the conveyor extends, means externally of the drying chamber for producing a flow of gas lengthwise through said drying chamber in the direction in which the material is conveyed through said drying chamber and maintaining a gas pressure less than atmospheric in the material exit end of said drying chamber, and means for heating the gas, the improvement comprising providing a gas seal chamber adjacent to the material discharge end of said drying chamber, said conveyor having pinch rolls at least at the material discharge end of said seal chamber, means adjacent to said pinch rolls at the material discharge end of said seal chamber for restricting the flow of gas into said seal chamber, an exhaust fan connected to said seal chamber, and means to control the amount of gas discharged from said seal chamber by said exhaust fan whereby the gas pressure in said seal chamber may be maintained less than the subatmospheric gas pressure in the discharge end of the drying chamber.

6. In apparatus for reducing the moisture content of material in sheet form comprising an elongated generally horizontal stationary housing having material entrance and discharge ends, a continuous conveyor extending through the housing for conveying material to be processed through the housing which includes a material drying chamber intermediate its ends and through which the conveyor extends, means externally of the drying chamber for producing a flow of gas lengthwise through said drying chamber in the direction in which the material is conveyed through said drying chamber and maintaining a gas pressure less than atmospheric in the material exit end of said drying chamber, and means for heating the gas, the improvement comprising providing a gas seal chamber adjacent to the material discharge end of said drying chamber, said conveyor having pinch rolls at least at the material discharge end of said seal chamber for restricting the flow of gas thereinto, an exhaust fan connected to said seal chamber, and means to control the amount of gas exhausted from said seal chamber by said exhaust fan to maintain a gas pressure in said seal chamber less than that of the subatmospheric gas pressure in the material discharge end of said drying chamber, said control means including means for sensing a gas pressure condition in said housing upstream from said seal chamber.

7. In apparatus for reducing the moisture content of rigid and/or semi-rigid material in sheet form comprising an elongated generally horizontal stationary housing having material entrance and discharge ends, a plurality of tiered roll-type generally horizontal, continuous conveyors extending through said housing for conveying material to be processed in linear paths through said housing which includes a material drying chamber intermediate its ends and through which the conveyor extends, means externally of the drying chamber for producing a flow of gas lengthwise through said drying chamber in the direction in which the material is conveyed through said drying chamber and maintaining a gas pressure less than atmospheric in the material exit end of said drying chamber, and means for heating the gas, the improvement comprising providing a gas seal chamber adjacent to the material discharge end of said drying chamber, said conveyor having pinch rolls at least at the material discharge end of said seal chamber, means adjacent to the material discharge end of said seal chamber for restricting the flow of gas into said seal chamber, an exhaust fan connected to said seal chamber and discharging through a stack having an adjustable damper, means for sensing a condition in housing upstream from said seal chamber, and means for adjusting said damper to control the amount of gas discharged from said seal chamber by said exhaust fan whereby the gas pressure in said seal chamber may be maintained less than the subatmospheric gas pressure in the discharge end of the drying chamber.

8. In a dryer for reducing the moisture content of material in sheet form comprising an elongated generally horizontal stationary housing having material entrance and discharge ends, a plurality of tiered roll-type generally horizontal, continuous conveyors extending through said housing for conveying material in sheet form to be processed in linear paths through said housing, said housing including a material drying chamber intermediate its ends and through which the conveyors extends, means externally of the drying chamber for producing a flow of gas lengthwise through said drying chamber in the direction in which the material is conveyed through said drying chamber and maintaining a gas pressure less than atmospheric in the material exit end of said drying chamber, and means for heating the gas, the improvement comprising providing a gas seal chamber adjacent to the material discharge end of said drying chamber, said conveyor having pinch rolls at least at the material discharge end of said seal chamber, means adjacent to the material discharge end of said seal chamber of restricting the flow of gas into said seal chamber, an exhaust fan connected to said seal chamber and discharging through a stack having an adjustable damper, and control means operatively connected to said damper for adjusting said damper to control the amount of gas exhausted from said seal by said exhaust fan to maintain a gas pressure said seal chamber less than that of the subatmospheric gas pressure in the material discharge end of said drying chamber, said control means including means for sensing a condition in said housing upstream from said seal chamber.

9. A method for reducing the moisture content of material in sheet form which comprises providing an elongated generally horizontal stationary housing having material entrance and discharge ends, a continuous conveyor extending through the housing for conveying material to be processed through the housing which includes a material drying chamber intermediate its ends and through which the conveyor extends, means externally of the drying chamber for producing a flow of gas lengthwise through the drying chamber in the direction in which the material is conveyed through the drying chamber, means for heating the gas, a gas seal chamber at the material discharge end of the drying chamber, means adjacent to the material discharge end of the seal chamber for restricting the flow of gas into the seal chamber, and an exhaust fan connected to the seal chamber; operating the means for producing the flow of gas through the drying chamber to maintain a gas pressure less than atmospheric in the material exit end of the drying chamber, and operating the exhaust fan connected to the seal chamber to maintain a gas pressure in the seal chamber less than the subatmospheric gas pressure in the material discharge end of the drying chamber.

* * * * *